US006305790B1

(12) United States Patent
Kawamura et al.

(10) Patent No.: US 6,305,790 B1
(45) Date of Patent: Oct. 23, 2001

(54) FULLY INTEGRATED THERMAL INKJET PRINTHEAD HAVING MULTIPLE INK FEED HOLES PER NOZZLE

(75) Inventors: Naoto A. Kawamura; Colin C. Davis; Timothy L. Weber, all of Corvallis; Kenneth E. Trueba, Philoma; John Paul Harmon, Albany; David R. Thomas, Corvallis, all of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/384,849

(22) Filed: Aug. 27, 1999

Related U.S. Application Data

(63) Continuation-in-part of application No. 09/314,551, filed on May 19, 1999, and a continuation-in-part of application No. 09/033,504, filed on Mar. 2, 1998, now Pat. No. 6,126,276, and a continuation-in-part of application No. 09/033,987, filed on Mar. 2, 1998, now Pat. No. 6,162,589, which is a continuation of application No. 08/597,746, filed on Feb. 7, 1996, now Pat. No. 6,000,787.

(51) Int. Cl.[7] ..... B41J 2/05
(52) U.S. Cl. ..... 347/65
(58) Field of Search ..... 347/56, 63, 65, 347/67; 216/27

(56) References Cited

U.S. PATENT DOCUMENTS

| | | | | |
|---|---|---|---|---|
| 4,438,191 | * | 3/1984 | Cloutier et al. | 430/324 |
| 4,558,333 | * | 12/1985 | Sugitani et al. | 347/65 |
| 4,789,425 | | 12/1988 | Drake et al. | 216/27 |
| 4,864,329 | | 9/1989 | Kneezel et al. | 347/93 |
| 4,866,461 | * | 9/1989 | Piatt | 347/63 |
| 4,894,664 | | 1/1990 | Tsung Pan | 347/63 |
| 5,016,024 | | 5/1991 | Lam et al. | 347/63 |
| 5,198,834 | | 3/1993 | Childers et al. | 347/65 |
| 5,322,594 | | 6/1994 | Bol | 216/27 |
| 5,463,411 | | 10/1995 | Wehl | 347/65 |
| 5,463,413 | * | 10/1995 | Ho et al. | 347/65 |
| 5,489,930 | | 2/1996 | Anderson | 347/71 |
| 5,638,101 | | 6/1997 | Keefe et al. | 347/65 |
| 5,648,806 | | 7/1997 | Steinfield et al. | 347/87 |
| 5,666,143 | * | 9/1997 | Burke et al. | 347/65 |
| 6,019,907 | * | 2/2000 | Kawamura | 216/27 |
| 6,065,823 | * | 5/2000 | Kawamura | 347/18 |

FOREIGN PATENT DOCUMENTS

| | | |
|---|---|---|
| 19836357A1 | 4/1999 | (DE) . |
| 0 244 214 A1 | 4/1987 | (EP) . |
| 838337A1 | 4/1999 | (EP) . |
| 940257A2 | 9/1999 | (EP) . |
| 1-190458 | 7/1989 | (JP) . |

OTHER PUBLICATIONS

European Search Report, 2 pages.

* cited by examiner

*Primary Examiner*—John Barlow
*Assistant Examiner*—Blaise L. Mouttet

(57) ABSTRACT

Described herein is a monolithic printhead formed using integrated circuit techniques. Thin film layers, including ink ejection elements, are formed on a top surface of a silicon substrate. The various layers are etched to provide conductive leads to the ink ejection elements. At least one ink feed hole is formed through the thin film layers for each ink ejection chamber. In one embodiment, there are more ink feed holes than ink ejection chambers, so that more than one ink feed hole provides ink to each ink ejection chamber. A trench is etched in the bottom surface of the substrate so that ink can flow into the trench and into each ink ejection chamber through the ink feed holes formed in the thin film layers. An orifice layer is formed on the top surface of the thin film layers to define the nozzles and ink ejection chambers.

26 Claims, 10 Drawing Sheets

FULLY INTEGRATED THERMAL INKJET PRINTHEAD HAVING MULTIPLE INK FEED HOLES PER NOZZLE

CROSS-REFERENCE TO RELATED APPLICATIONS

This is a continuation-in-part of U.S. application Ser. No. 09/033,504, filed Mar. 2, 1998 now U.S. Pat. No. 6,126,276, entitled, "Fluid Jet Printhead With Integrated Heat Sink," by Colin Davis et al., and a continuation-in-part of U.S. patent application Ser. No. 09/314,551, filed May 19, 1999, entitled, "Solid State Ink Jet Printhead And Method Of Manufacture," by Timothy Weber et al., which is a continuation of U.S. patent application Ser. No. 08/597,746, filed Feb. 7, 1996 now U.S. Pat. No. 6,000,787 and a continuation-in-part of U.S. patent application Ser. No. 09/033,987, filed Mar. 2, 1998 now U.S. Pat. No. 6,162,589, entitled "Direct Imaging Polymer Fluid Jet Orifice," by Chien-Hua Chen, Naoto Kamamura et al. These applications are assigned to the present assignee and incorporated herein by reference.

FIELD OF THE INVENTION

This invention relates to inkjet printers and, more particularly, to a monolithic printhead for an inkjet printer.

BACKGROUND

Inkjet printers typically have a printhead mounted on a carriage that scans back and forth across the width of a sheet of paper feeding through the printer. Ink from an ink reservoir, either on-board the carriage or external to the carriage, is fed to ink ejection chambers on the printhead. Each ink ejection chamber contains an ink ejection element, such as a heater resistor or a piezoelectric element, which is independently addressable. Energizing an ink ejection element causes a droplet of ink to be ejected through a nozzle for creating a small dot on the medium. The pattern of dots created forms an image or text.

As dot resolutions (dots per inch) increase along with the firing frequencies, more heat is generated by the firing elements. This heat needs to be dissipated. Heat is dissipated by a combination of the ink being ejected and the printhead substrate sinking heat from the ink ejection elements. The substrate may even be cooled by the supply of ink flowing to the printhead.

Additional information regarding one particular type of printhead and inkjet printer is found in U.S. Pat. No. 5,648,806, entitled, "Stable Substrate Structure For A Wide Swath Nozzle Array In A High Resolution Inkjet Printer," by Steven Steinfield et al., assigned to the present assignee and incorporated herein by reference.

As the resolutions and printing speeds of printheads increase to meet the demanding needs of the consumer market, new printhead manufacturing techniques and structures are required. Hence, there is a need for an improved printhead that has at least the following properties: adequately sinks heat from the ink ejection elements at high operating frequencies; provides an adequate refill speed of the ink ejection chambers with minimum blowback; minimizes cross-talk between nearby ink ejection chambers; is tolerant to particles within the ink; provides a high printing resolution; enables precise alignment of the nozzles and ink ejection chambers; provides a precise and predictable drop trajectory; is relatively easy and inexpensive to manufacture; and is reliable.

SUMMARY

Described herein is a monolithic printhead formed using integrated circuit techniques. Thin film layers, including a resistive layer, are formed on a top surface of a silicon substrate. The various layers are etched to provide conductive leads to the heater resistor elements. Piezoelectric elements may be used instead of the resistive elements. An optional thermally conductive layer below the heater resistors sinks heat from the heater resistors and transfers the heat to a combination of the silicon substrate and the ink.

At least one ink feed hole is formed through the thin film layers for each ink ejection chamber. In one embodiment, there are more ink feed holes than ink ejection chambers, so that more than one ink feed hole provides ink to each ink ejection chamber. If one feed hole becomes clogged with a particle, another feed hole can adequately refill the chamber.

A trench is etched in the bottom surface of the substrate so that ink can flow into the trench and into each ink ejection chamber through the ink feed holes formed in the thin film layers.

An orifice layer is formed on the top surface of the thin film layers to define the nozzles and ink ejection chambers. In one embodiment, a photodefinable material is used to form the orifice layer.

Various thin film structures are described as well as various ink feed arrangements and orifice layers.

The resulting fully integrated thermal inkjet printhead can be manufactured to a very precise tolerance since the entire structure is monolithic, meeting the needs for the next generation of printheads.

DETAILED DESCRIPTION OF THE EMBODIMENTS

Figure 1:
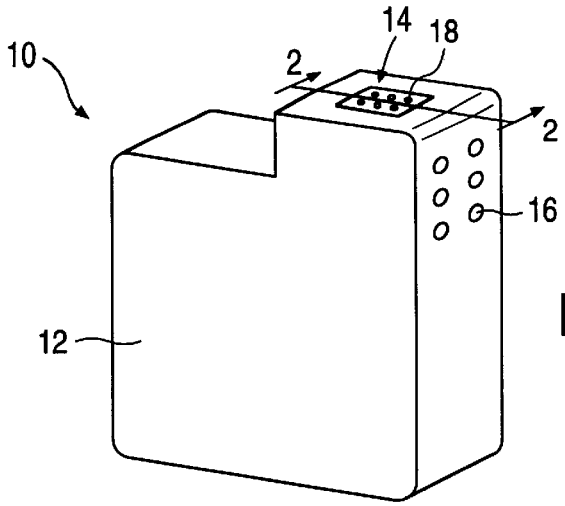
FIG. 1 is a perspective view of one embodiment of a print cartridge that may incorporate any one of the printheads described herein.

FIG. 1 is a perspective view of one type of inkjet print cartridge 10 which may incorporate the printhead structures of the present invention. The print cartridge 10 of FIG. 1 is the type that contains a substantial quantity of ink within its body 12, but another suitable print cartridge may be the type that receives ink from an external ink supply either mounted on the printhead or connected to the printhead via a tube.

The ink is supplied to a printhead 14. Printhead 14, to be described in detail later, channels the ink into ink ejection chambers, each chamber containing an ink ejection element. Electrical signals are provided to contacts 16 to individually energize the ink ejection elements to eject a droplet of ink through an associated nozzle 18. The structure and operation of conventional print cartridges are very well known.

The present invention relates to the printhead portion of a print cartridge, or a printhead that can be permanently installed in a printer, and, thus, is independent of the ink delivery system that provides ink to the printhead. The invention is also independent of the particular printer into which the printhead is incorporated.

Figure 2:
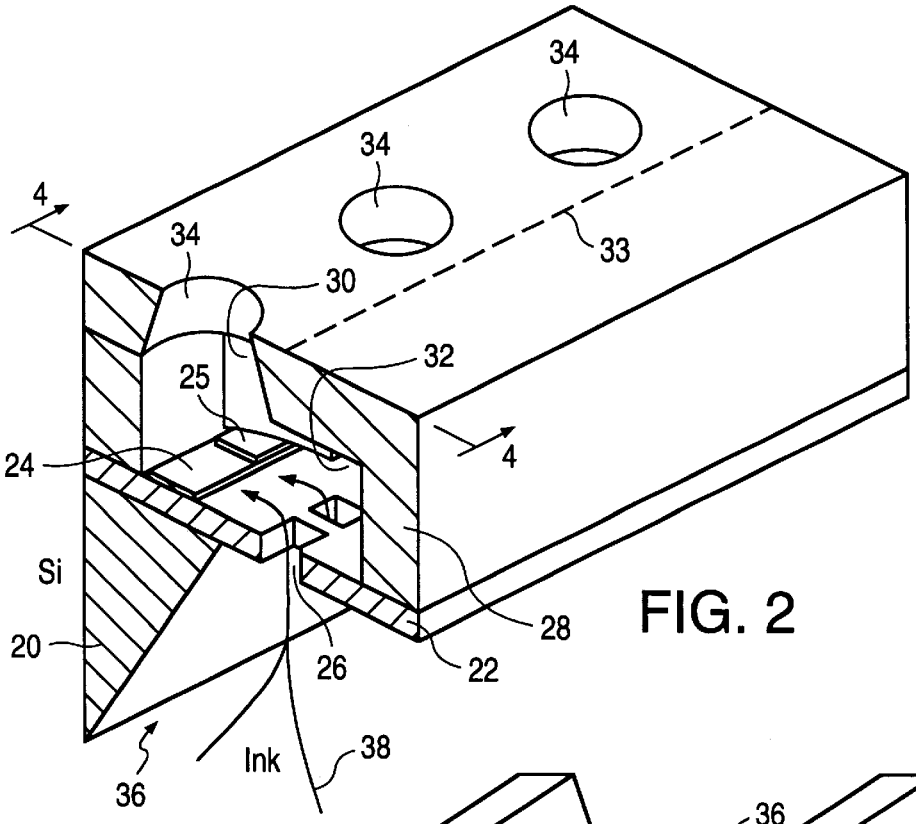
FIG. 2 is a perspective cutaway view of a portion of one embodiment of a printhead in accordance with the present invention.

FIG. 2 is a cross-sectional view of a portion of the printhead of FIG. 1 taken along line 2—2 in FIG. 1. Although a printhead may have 300 or more nozzles and associated ink ejection chambers, detail of only a single ink ejection chamber need be described in order to understand the invention. It should also be understood by those skilled in the art that many printheads are formed on a single silicon wafer and then separated from one another using conventional techniques.

In FIG. 2, a silicon substrate 20 has formed on it various thin film layers 22, to be described in detail later. The thin film layers 22 include a resistive layer for forming resistors 24. Other thin film layers perform various functions, such as providing electrical insulation from the substrate 20, providing a thermally conductive path from the heater resistor elements to the substrate 20, and providing electrical conductors to the resistor elements. One electrical conductor 25 is shown leading to one end of a resistor 24. A similar conductor leads to the other end of the resistor 24. In an actual embodiment, the resistors and conductors in a chamber would be obscured by overlying layers.

Ink feed holes 26 are formed completely through the thin film layers 22.

An orifice layer 28 is deposited over the surface of the thin film layers 22 and etched to form ink ejection chambers 30, one chamber per resistor 24. A manifold 32 is also formed in the orifice layer 28 for providing a common ink channel for a row of ink ejection chambers 30. The inside edge of the manifold 32 is shown by a dashed line 33. Nozzles 34 may be formed by laser ablation using a mask and conventional photolithography techniques.

The silicon substrate 20 is etched to form a trench 36 extending along the length of the row of ink feed holes 26 so that ink 38 from an ink reservoir may enter the ink feed holes 26 for supplying ink to the ink ejection chambers 30.

In one embodiment, each printhead is approximately one-half inch long and contains two offset rows of nozzles, each row containing 150 nozzles for a total of 300 nozzles per printhead. The printhead can thus print at a single pass resolution of 600 dots per inch (dpi) along the direction of the nozzle rows or print at a greater resolution in multiple passes. Greater resolutions may also be printed along the scan direction of the printhead. Resolutions of 1200 or greater dpi may be obtained using the present invention.

In operation, an electrical signal is provided to heater resistance 24, which vaporizes a portion of the ink to form a bubble within an ink ejection chamber 30. The bubble propels an ink droplet through an associated nozzle 34 onto a medium. The ink ejection chamber is then refilled by capillary action.

Figure 3:
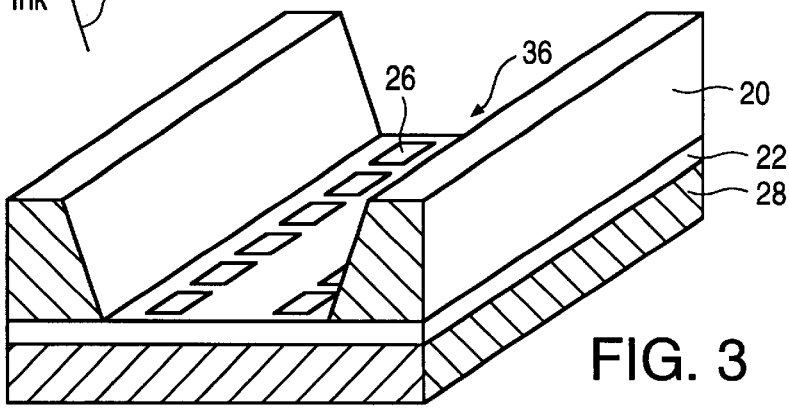
FIG. 3 is a perspective view of the underside of the printhead shown in FIG. 2.

FIG. 3 is a perspective view of the underside of the printhead of FIG. 2 showing trench 36 and ink feed holes 26. In the particular embodiment of FIG. 3, a single trench 36 provides access to two rows of ink feed holes 26.

In one embodiment, the size of each ink feed hole 26 is smaller than the size of a nozzle 34 so that particles in the ink will be filtered by the ink feed holes 26 and will not clog a nozzle 34. The clogging of an ink feed hole 26 will have little effect on the refill speed of a chamber 30 since there are multiple ink feed holes 26 supplying ink to each chamber 30. In one embodiment, there are more ink feed holes 26 than ink ejection chambers 30.

Figure 4:
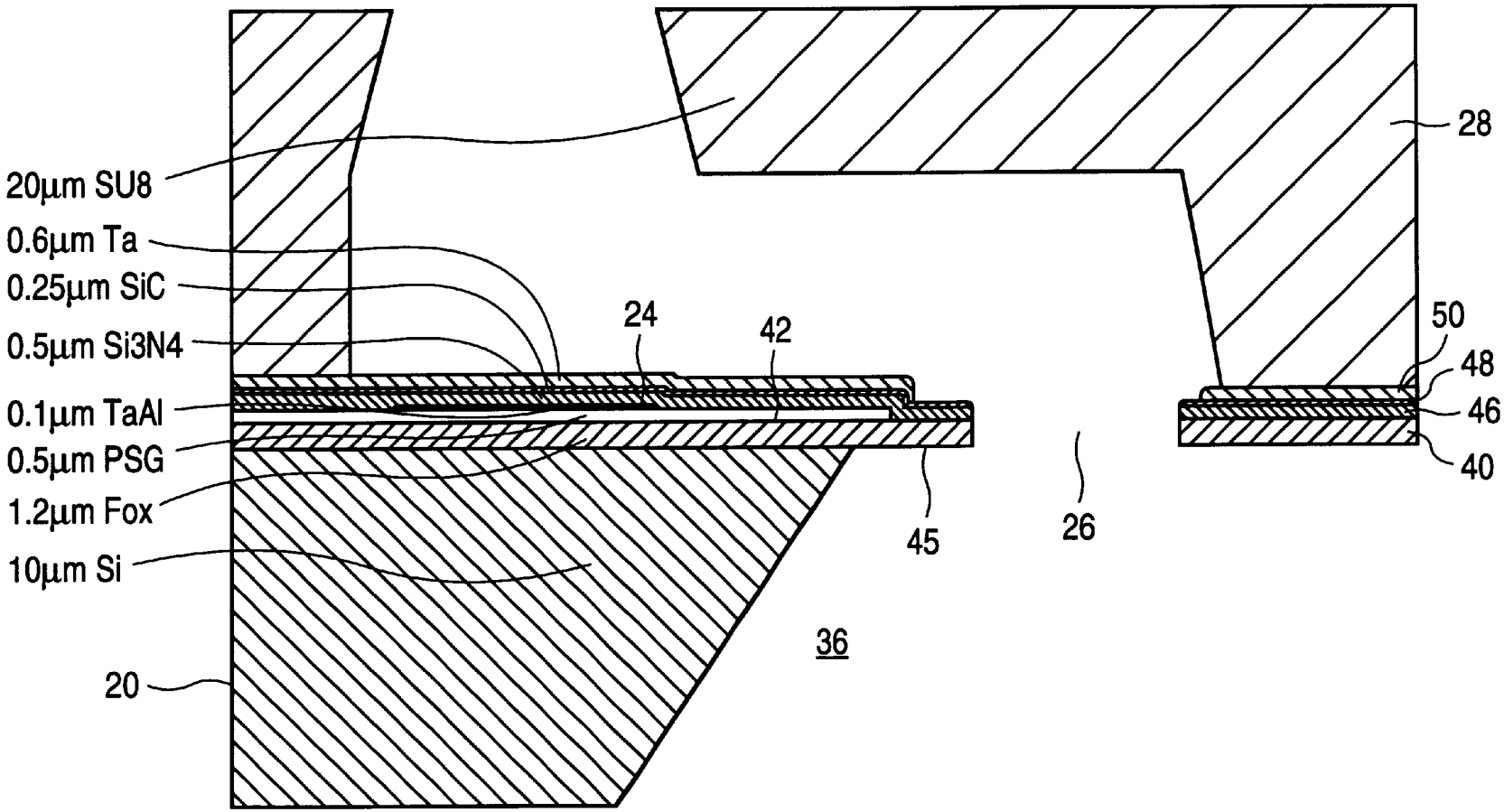
FIG. 4 is a cross-sectional view along line 4—4 in FIG. 2.

FIG. 4 is a cross-sectional view along line 4—4 of FIG. 2. FIG. 4 shows the individual thin film layers. In the particular embodiment of FIG. 4, the portion of the silicon substrate 20 shown is about 10 microns thick. This portion is referred to as the bridge. The bulk silicon is about 675 microns thick.

A field oxide layer 40, having a thickness of 1.2 microns, is formed over silicon substrate 20 using conventional techniques. A phosphosilicate glass (PSG) layer 42, having a thickness of 0.5 microns, is then applied over the layer of oxide 40.

A boron PSG or boron TEOS (BTEOS) layer may be used instead of layer 42 but etched in a manner similar to the etching of layer 42.

A resistive layer of, for example, tantalum aluminum (TaAl), having a thickness of 0.1 microns, is then formed over the PSG layer 42. Other known resistive layers can also be used. The resistive layer, when etched, forms resistors 24. The PSG and oxide layers, 42 and 40, provide electrical insulation between the resistors 24 and substrate 20, provide an etch stop when etching substrate 20, and provide a mechanical support for the overhang portion 45. The PSG and oxide layers also insulate polysilicon gates of transistors (not shown) used to couple energization signals to the resistors 24.

It is difficult to perfectly align the backside mask (for forming trench 36) with the ink feed holes 26. Thus, the manufacturing process is designed to provide a variable overhang portion 45 rather than risk having the substrate 20 interfere with the ink feed holes 26.

Not shown in FIG. 4, but shown in FIG. 2, is a patterned metal layer, such as an aluminum-copper alloy, overlying the resistive layer for providing an electrical connection to the resistors. Traces are etched into the AlCu and TaAl to define a first resistor dimension (e.g., a width). A second resistor dimension (e.g., a length) is defined by etching the AlCu layer to cause a resistive portion to be contacted by AlCu traces at two ends. This technique of forming resistors and electrical conductors is well known in the art.

Over the resistors 24 and AlCu metal layer is formed a silicon nitride ($Si_3N_4$) layer 46, having a thickness of 0.5 microns. This layer provides insulation and passivation. Prior to the nitride layer 46 being deposited, the PSG layer 42 is etched to pull back the PSG layer 42 from the ink feed hole 26 so as not to be in contact with any ink. This is important because the PSG layer 42 is vulnerable to certain inks and the etchant used to form trench 36.

Etching back a layer to protect the layer from ink may also apply to the polysilicon and metal layers in the printhead.

Over the nitride layer 46 is formed a layer 48 of silicon carbide (SiC), having a thickness of 0.25 microns, to provide additional insulation and passivation. The nitride layer 46 and carbide layer 48 now protect the PSG layer 42 from the ink and etchant. Other dielectric layers may be used instead of nitride and carbide.

The carbide layer 48 and nitride layer 46 are etched to expose portions of the AlCu traces for contact to subsequently formed ground lines (out of the field of FIG. 4).

On top of the carbide layer 48 is formed an adhesive layer 50 of tantalum (Ta), having a thickness of 0.6 microns. The tantalum also functions as a bubble cavitation barrier over the resistor elements. This layer 50 contacts the AlCu conductive traces through the openings in the nitride/carbide layers.

Gold (not shown) is deposited over the tantalum layer 50 and etched to form ground lines electrically connected to certain ones of the AlCu traces. Such conductors may be conventional.

The AlCu and gold conductors may be coupled to transistors formed on the substrate surface. Such transistors are described in U.S. Pat. No. 5,648,806, previously mentioned. The conductors may terminate at electrodes along edges of the substrate 20.

A flexible circuit (not shown) has conductors which are bonded to the electrodes on the substrate 20 and terminate in contact pads 16 (FIG. 1) for electrical connection to the printer.

The ink feed holes 26 are formed by etching through the thin film layers. In one embodiment, a single feed hole mask is used. In another embodiment, several masking and etching steps are used as the various thin film layers are formed.

The orifice layer 28 is then deposited and formed, followed by the etching of the trench 36. In another embodiment, the trench etch is conducted before the orifice layer fabrication. The orifice layer 28 may be formed of a spun-on epoxy called SU8. The orifice layer in one embodiment is about 20 microns.

A backside metal may be deposited if necessary to better conduct heat from substrate 20 to the ink.

Figure 5:
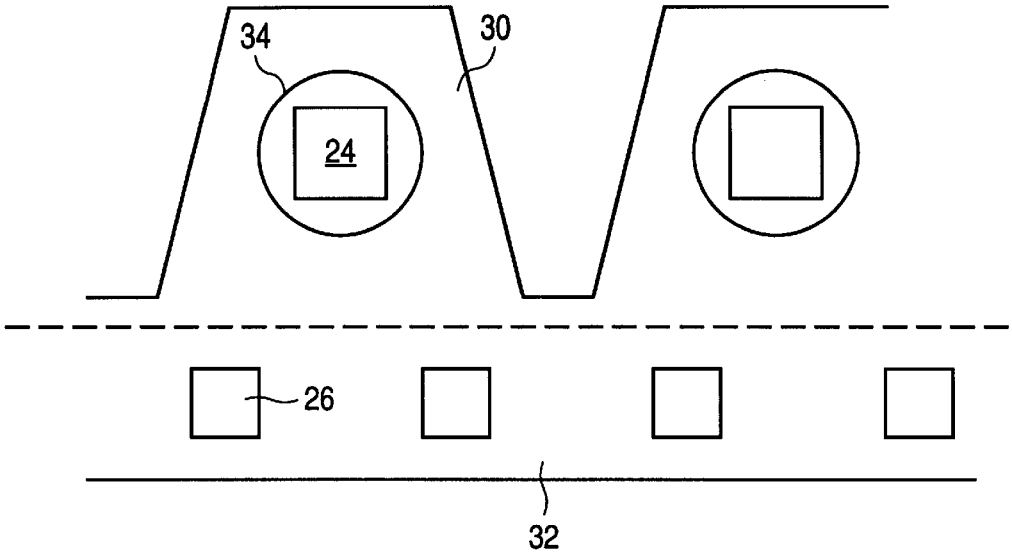
FIG. 5 is a top-down view of the printhead of FIG. 2 with a transparent orifice layer.

FIG. 5 is a top-down view of the structure of FIG. 2. The dimensions of the elements may be as follows: ink feed holes 26 are 10 microns×20 microns; ink ejection chambers 30 are 20 microns×40 microns; nozzles 34 have a diameter of 16 microns; heater resistors 24 are 15 microns×15 microns; and manifold 32 has a width of about 20 microns. The dimensions will vary depending on the ink used, the operating temperature, the printing speed, the desired resolution, and other factors.

Figure 6:
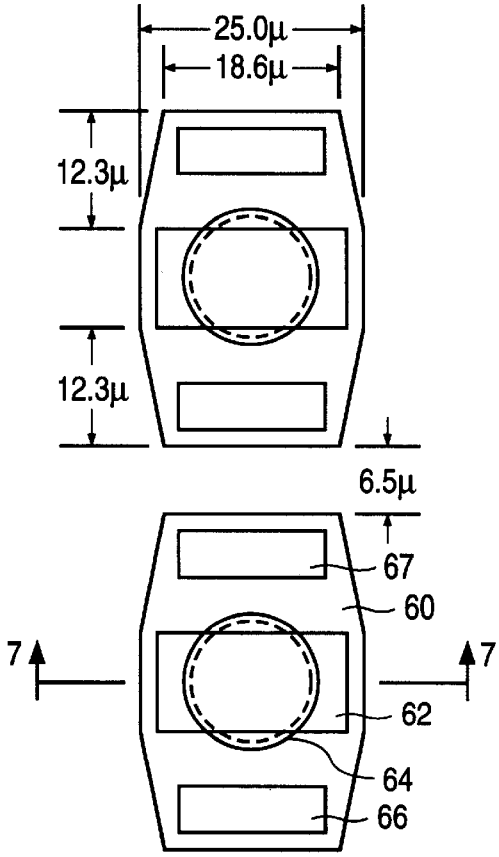
FIG. 6 is a top-down view of a portion of an alternative embodiment printhead.
Figure 7:
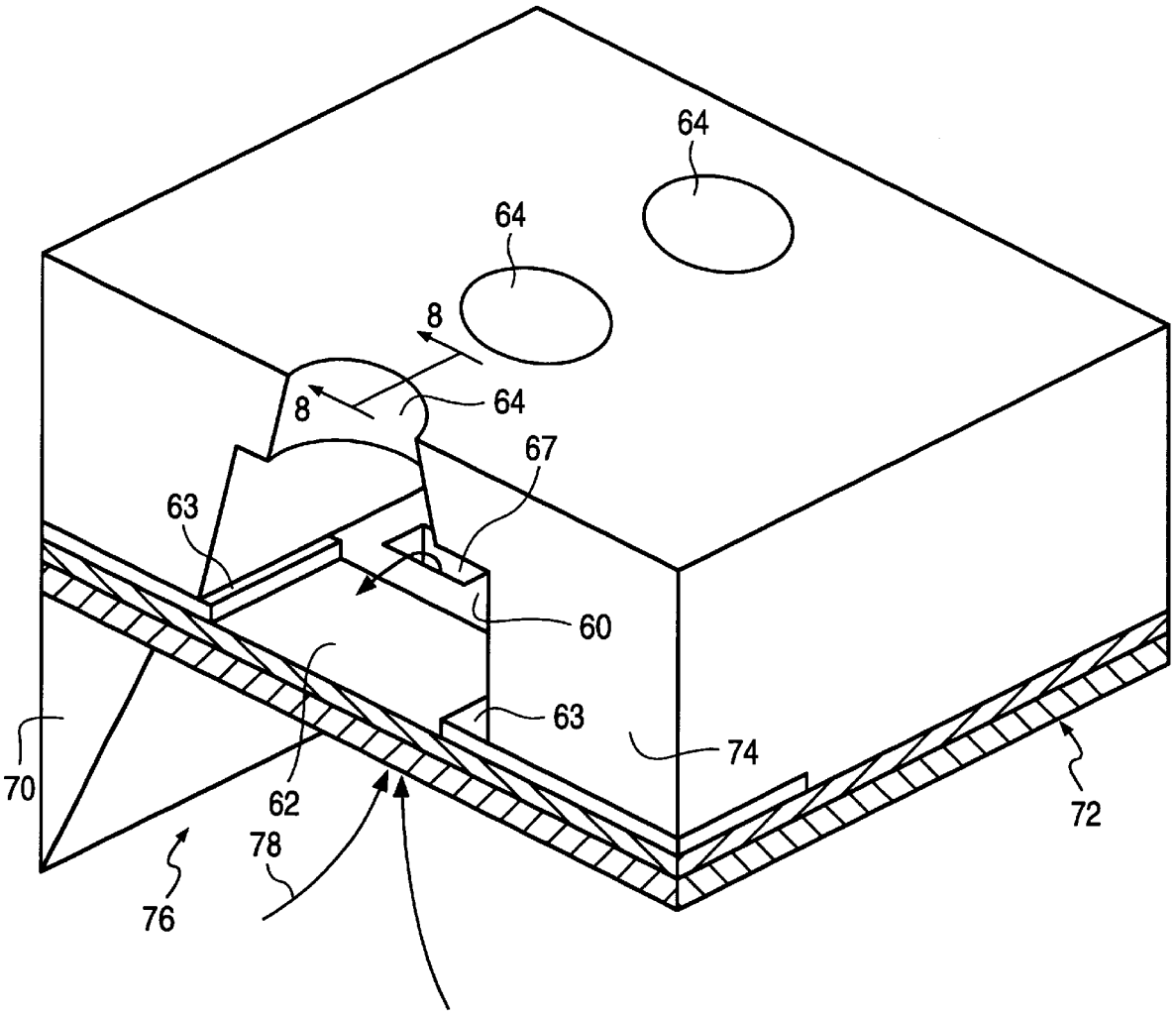
FIG. 7 is a perspective cutaway view taken along line 7—7 in FIG. 6.
Figure 8:
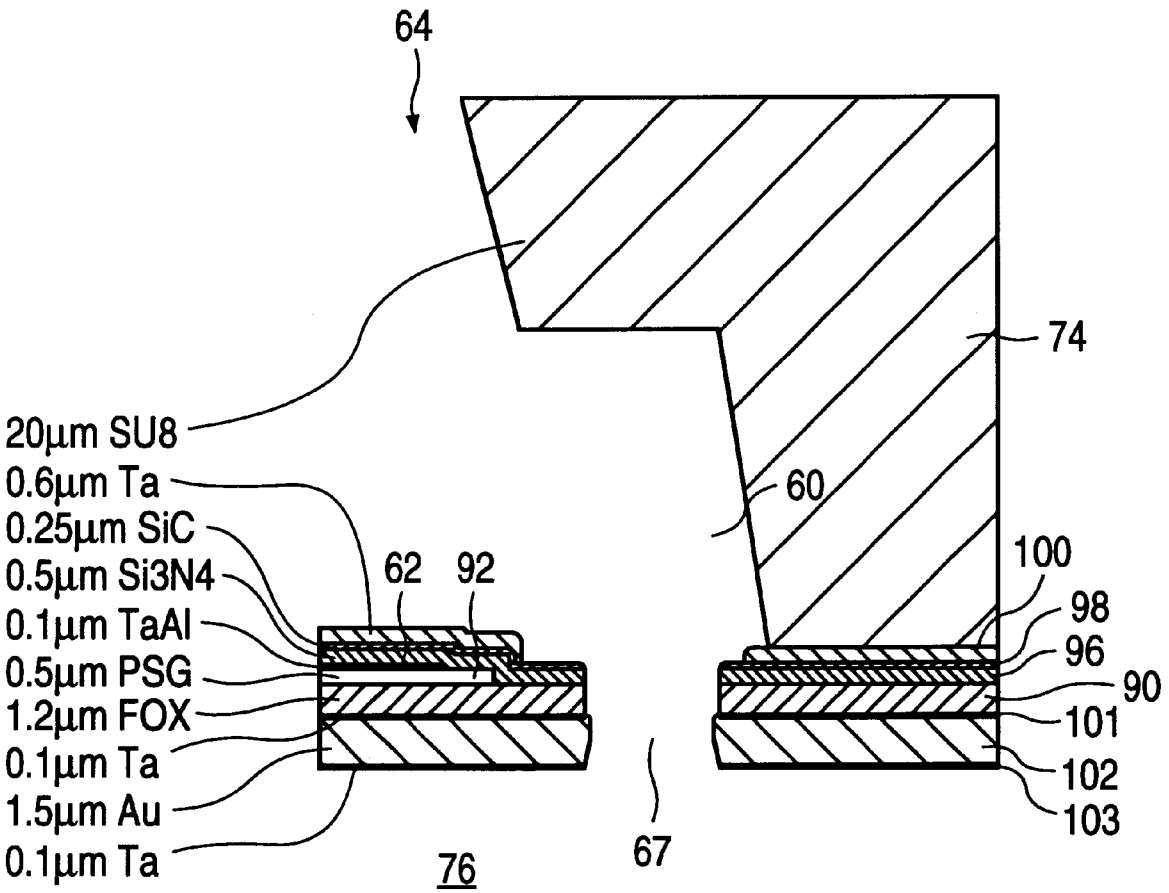
FIG. 8 is a cross-sectional view taken along line 8—8 in FIG. 7.
Figure 9:
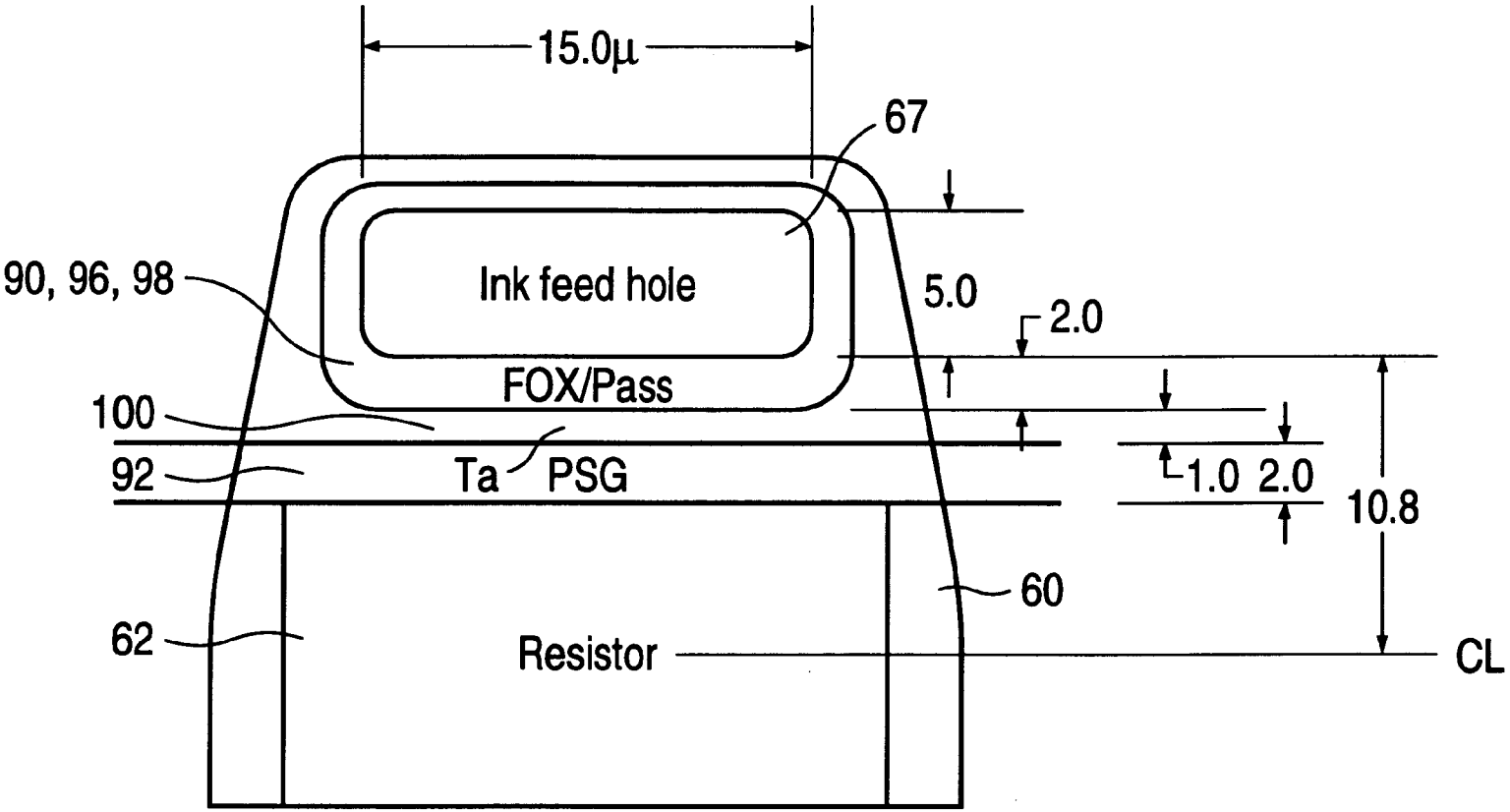
FIG. 9 is a top-down view showing in greater detail a portion of a single ink ejection chamber in the printhead embodiment of FIG. 8.

FIG. 6 is a top-down view of a portion of an alternative embodiment printhead. In this printhead, there is no ink manifold. Ink to each ink ejection chamber is provided by two dedicated ink feed holes. Other views of this printhead are shown in FIGS. 7, 8, and 9. In the embodiment shown, there are twice as many ink feed holes as heater resistors. In another embodiment, there are one or more dedicated ink feed holes for each chamber.

In FIG. 6, the outline of an ink ejection chamber 60 is shown along with a heater resistor 62, a nozzle 64 (with the smaller diameter of the nozzle shown in dashed outline), and ink feed holes 66 and 67. Ink 10 feed holes 66 and 67 are designed to be smaller than nozzle 64 so as to filter any particles before reaching chamber 60. If a particle clogs one ink feed hole, the size of the other ink feed hole is adequate to refill chamber 60 at close to the operating frequency.

FIG. 7 is a cross-sectional perspective view along line 7—7 in FIG. 6 illustrating a single ink ejection chamber 60.

In FIG. 7, a silicon substrate 70 has formed on it a plurality of thin film layers 72 (to be identified in FIG. 8), including a resistive layer and an AlCu layer that are etched to form the heater resistors 62. AlCu conductors 63 are shown leading to the resistors 62.

Ink feed holes 67 are formed through the thin film layers 72 to extend to the surface of the silicon substrate 70. An orifice layer 74 is then formed over the thin film layers 72 to define ink ejection chambers 60 and nozzles 64. The silicon substrate 70 is etched to form a trench 76 extending the length of the row of ink ejection chambers. The trench 76 may be formed prior to the orifice layer. Ink 78 from an ink reservoir is shown flowing into trench 76, through ink feed hole 67, and into chamber 60.

FIG. 8 is a cross-sectional view along line 8—8 in FIG. 7 showing one-half of chamber 60. The other half is symmetrical with FIG. 8. Unlike the first embodiment, where a portion of the silicon substrate 20 was located directly beneath the heater resistors to sink heat from the resistors, the structure of FIG. 8 uses a metal layer beneath the heater resistors to draw heat away from the resistors and transfer the heat to the substrate and to the ink itself.

An insulating layer of field oxide 90, having a thickness of 1.2 microns, is formed over the silicon substrate 70 (FIG. 7) prior to the trench 76 being formed. The portion of the printhead in FIG. 8 is shown after the trench 76 is formed so the substrate 70 is not shown in the field of view.

A PSG layer 92 having a thickness of 0.5 microns is then deposited over oxide 90. As described with respect to FIG. 4, the oxide and PSG layers provide electrical insulation and thermal conductivity between the heater resistor and the underlying conductive layers, as well as provide increased mechanical support of the bridge extending between the remaining silicon substrate portions after the trench 76 is etched. Also, as previously mentioned, the PSG layer 92 is pulled back from the ink feed hole 67 to prevent contact with the ink which would otherwise react with the PSG.

Formed over the PSG layer 92 is a resistive layer of tantalum aluminum, having a thickness of 0.1 microns. An AlCu layer (not shown) is formed over the TaAl layer. The TaAl layer and AlCu layer are etched as previously described to form the various heater resistors 62 and conductors 63 (FIG. 7).

A layer of nitride 96, having a thickness of 0.5 microns, is then formed over the resistors 62 and AlCu conductors, followed by a layer of silicon carbide 98, having a thickness of 0.25 microns. The nitride/carbide layers are etched to expose portions of the AlCu conductors.

An adhesive layer 100 of tantalum, having a thickness of 0.6 microns, is then deposited, followed by a conductive layer of gold. Both layers are then etched to form gold conductors electrically contacting certain AlCu conductors leading to heater resistors 62 and ultimately terminating in bonding pads along edges of the substrate. In one embodiment, the gold conductors are ground lines.

The ink feed holes 67 are then etched through the thin film layers (or patterned during fabrication of the thin film layers). The orifice layer 74 is deposited and etched to form chambers 60 and nozzles 64. Nozzles 64 may also be formed by laser ablation.

The back side of the substrate 70 (FIG. 7) is then masked and etched using a TMAH etch to form the trench 76, extending the length of a row of ink ejection chambers 60. Any one of several etch techniques could be used, wet or dry. Examples of dry etches include XeF2 and SiF6. Examples of appropriate wet etches include Ethylene Diamine Pyrocatechol (EDP), Potassium Hydroxide (KOH), and TMAH. Other etches may also be used. Any one of these or a combination thereof could be used for this application.

The trench 76 may have a width of approximately one ink ejection chamber or may have a width that encompasses multiple rows of ink ejection chambers. The trench may be formed at any time during the fabrication process.

After the trench 76 is formed, an adhesion layer 101 of tantalum (Ta), having a thickness of 0.1 microns, is formed on the back side of the wafer overlying the field oxide 90. A heat conducting layer 102 of, for example, gold (Au), having a thickness of 1.5 microns, is then formed over the adhesion layer 101. Another adhesion layer 103 of tantalum, having a thickness of 0.1 microns, is then formed over the heat conducting layer 102.

FIG. 9 is a top-down view of one-half of an ink ejection chamber 60 in the printhead of FIG. 6. FIG. 9 illustrates the etching of the various layers and is to be taken in conjunction with FIG. 8. Starting with the ink feed hole 67, the oxide and passivation layers 90, 96, and 98 form a shelf approximately 2 microns long. The shelf length could be other sizes, for example, 1–100 microns. The tantalum layer 100 (used as an adhesive layer for gold conductors) is shown extending 1 micron beyond the PSG layer 92, and the PSG layer 92 is shown extending 2 microns beyond the resistor 62.

FIGS. 10A–10F are cross-sectional views of a portion of the wafer during various steps during the manufacturing of the printhead of FIG. 8. Conventional deposition, masking, and etching steps are used unless otherwise noted.

Figure 10A:
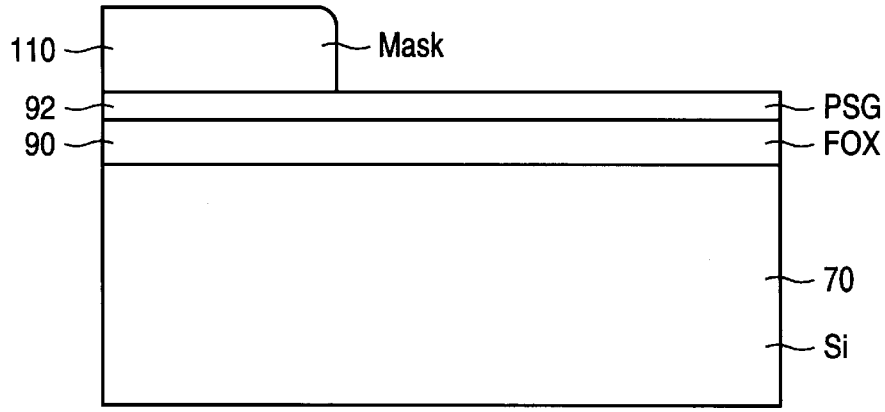
FIGS. 10A–10F are cross-sectional views of the printhead of FIG. 8 during various stages of the manufacturing process.

In FIG. 10A, a silicon substrate 70 with a crystalline orientation of (111) is placed in a vacuum chamber. Field oxide 90 is grown in a conventional manner. PSG layer 92 is then deposited using conventional techniques. FIG. 10A shows mask 110 being formed over the PSG layer 92 using conventional photolithographic techniques. The PSG layer 92 is then etched using conventional Reactive Ion Etching (RIE) to pull back the PSG layer 92 from the subsequently formed ink feed hole.

Figure 10B:
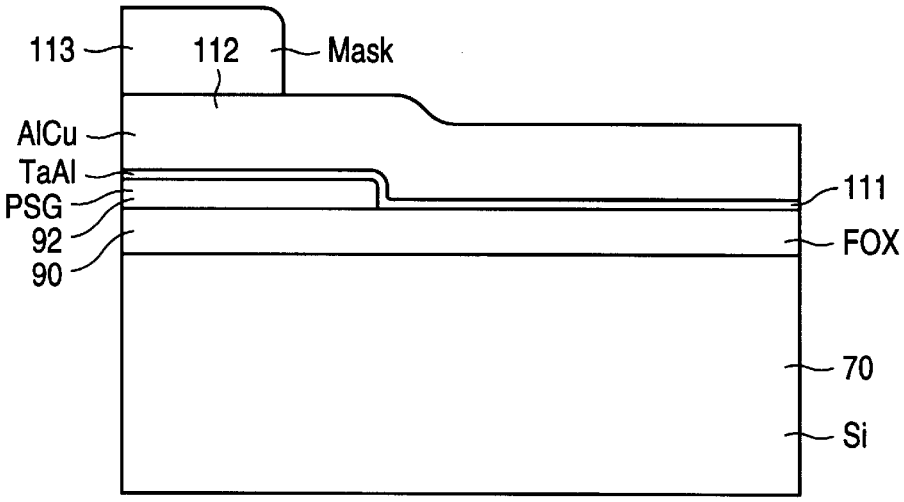

In FIG. 10B, mask 110 is removed and a resistive layer 111 of TaAl is deposited over the surface of the wafer. A conductive layer 112 of AlCu is then deposited over the TaAl. A first mask 113 is deposited and patterned using conventional photolithographic techniques, and the conductive layer 112 and the resistive layer 111 are etched using conventional IC fabrication techniques. Another masking and etching step (not shown) is used to remove the portions of the AlCu over the heater resistors 62, as previously described. The resulting AlCu conductors are outside the field of view of FIGS. 10A–10F.

Figure 10C:
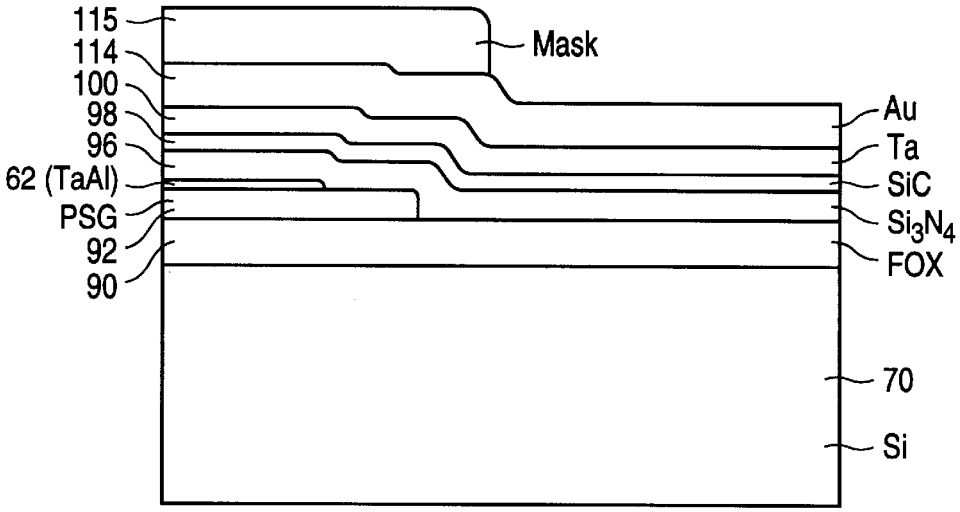

In FIG. 10C, the passivation layers, nitride 96 and carbide 98, are then deposited on the surface of the wafer using conventional techniques. The passivation layers are then masked (outside the field of view) and etched using conventional techniques to expose portions of the AlCu conductive traces for electrical contact to a subsequent gold conductive layer.

An adhesive layer 100 of tantalum and a conductive layer of gold 114 are then deposited over the wafer, masked, using a first mask 115, and etched, using conventional techniques to form the ground lines, terminating in bond pads along edges of the substrate. A second mask (not shown) removes portions of the gold over the Ta adhesive layer 100, such as over the heater resistor area.

Figure 10D:
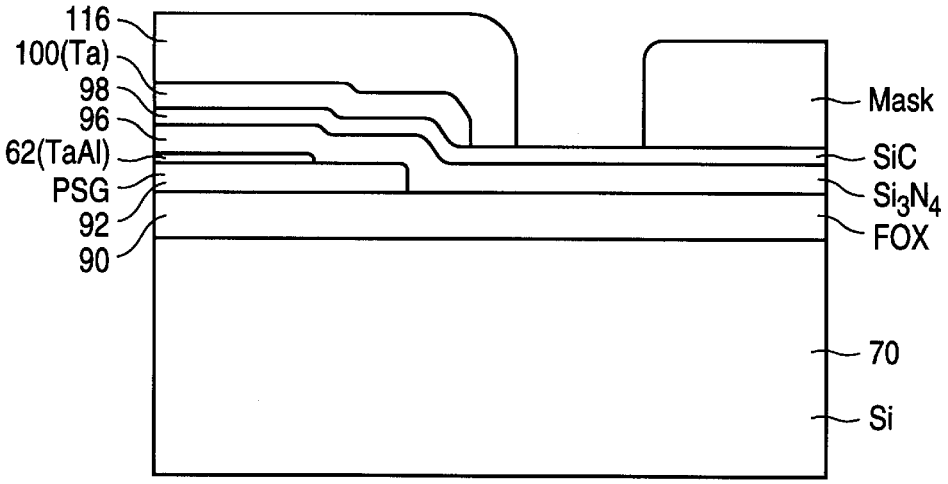

FIG. 10D illustrates the resulting structure, after the steps of FIG. 10C, having a mask 116 exposing a portion of the thin film layers to be etched to form the ink feed holes. Alternatively, multiple masking and etching steps may be used as the various thin film layers are formed to etch the ink feed holes.

Figure 10E:
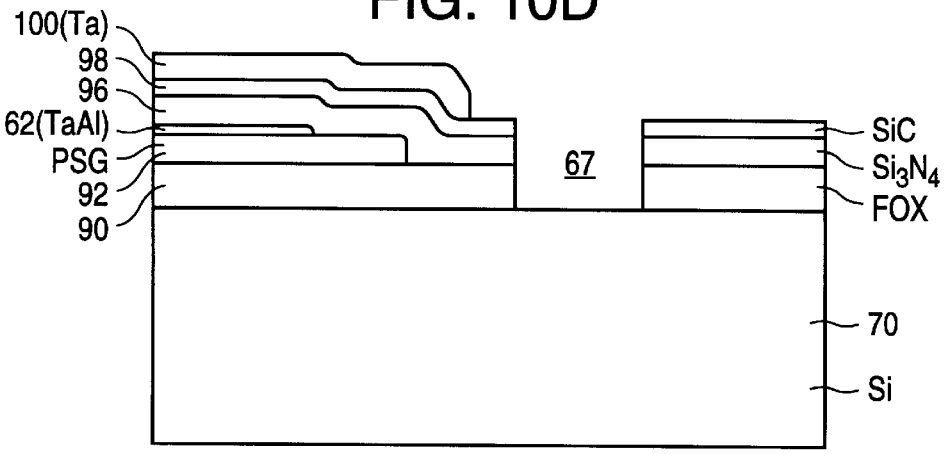

FIG. 10E illustrates the structure after etching the thin film layers. The thin film layers are etched using an anisotropic etch. This ink feed etch process can be a combination of several types of etches (RIE or wet). The ink feed holes 67 could be fabricated with an etch in combination with the films being patterned during fabrication. The holes 67 could be defined with one mask and etch step or with a series of etches. All the etches may use conventional IC fabrication techniques.

The back side of the wafer is then masked using conventional techniques to expose the ink trench portion 76 (see FIG. 7). The trench 76 is etched using a wet-etching process using tetramethyl ammonium hydroxide (TMAH) as an etchant to form the angled profile. Other wet anisotropic etchants may also be used. (See U. Schnakenberg et al., *TMAHW Etchants for Silicon Micromachining*, Tech Digest, 6th Int. Conf. Solid State Sensors and Actuators (Transducers '91), San Francisco, Calif., Jun. 24–28, 1991, pp. 815–818.) Such a wet etch will form the angled trench 76. The trench 76 may extend the length of the printhead or, to improve the mechanical strength of the printhead, only extend a portion of the length of the printhead beneath the ink ejection chambers 60. A passivation layer may be deposited on the substrate if reaction of the substrate with the ink is a concern.

Figure 10F:
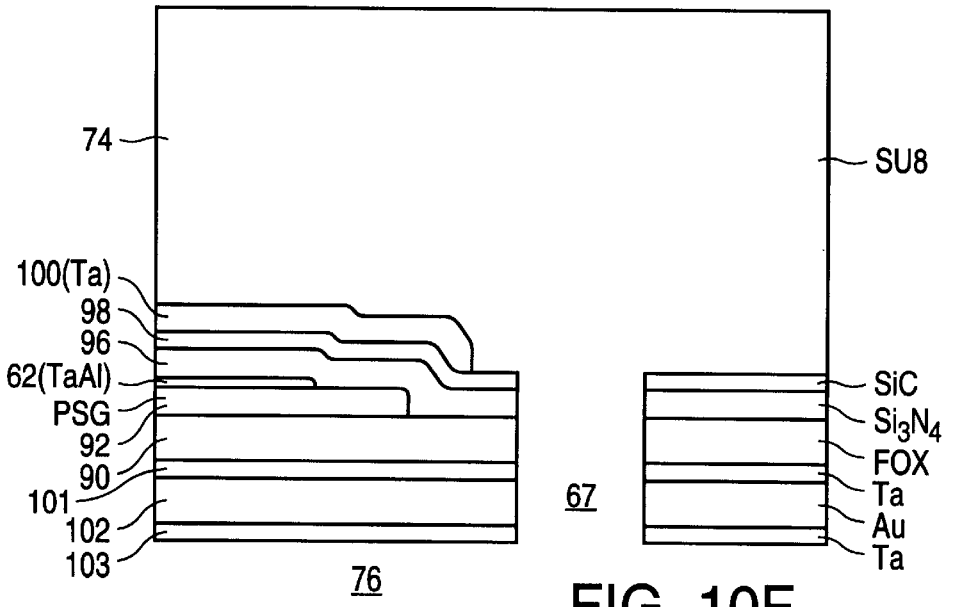

In FIG. 10F, a tantalum adhesive layer 101 is then flash evaporated or sputtered over the bottom surface of the substrate followed by a gold heat conductive layer 102 and another tantalum layer 103. These layers act as thermally conductive layers and provide mechanical strength to the bridge portion.

FIG. 10F also shows the formation of the orifice layer 74. Orifice layer 74, in one embodiment, is a photo-imagible material, such as SU8. Orifice layer 74 may be laminated, screened, or spun-on. The ink chambers and nozzles are formed through photolithography.

The resulting structure after etching of the orifice layer 74 is shown in FIG. 8. The orifice layer 74 may also be formed in a two-stage process, with a first layer being formed to define the ink chambers and the second layer being formed to define the nozzles.

The resulting wafer is then sawed to form the individual printheads, and a flexible circuit (not shown) used to provide electrical access to the conductors on the printhead is then connected to the bonding pads at the edges of the substrate. The resulting assembly is then affixed to a plastic print cartridge, such as that shown in FIG. 1, and the printhead is sealed with respect to the print cartridge body to prevent ink seepage.

Figure 11:
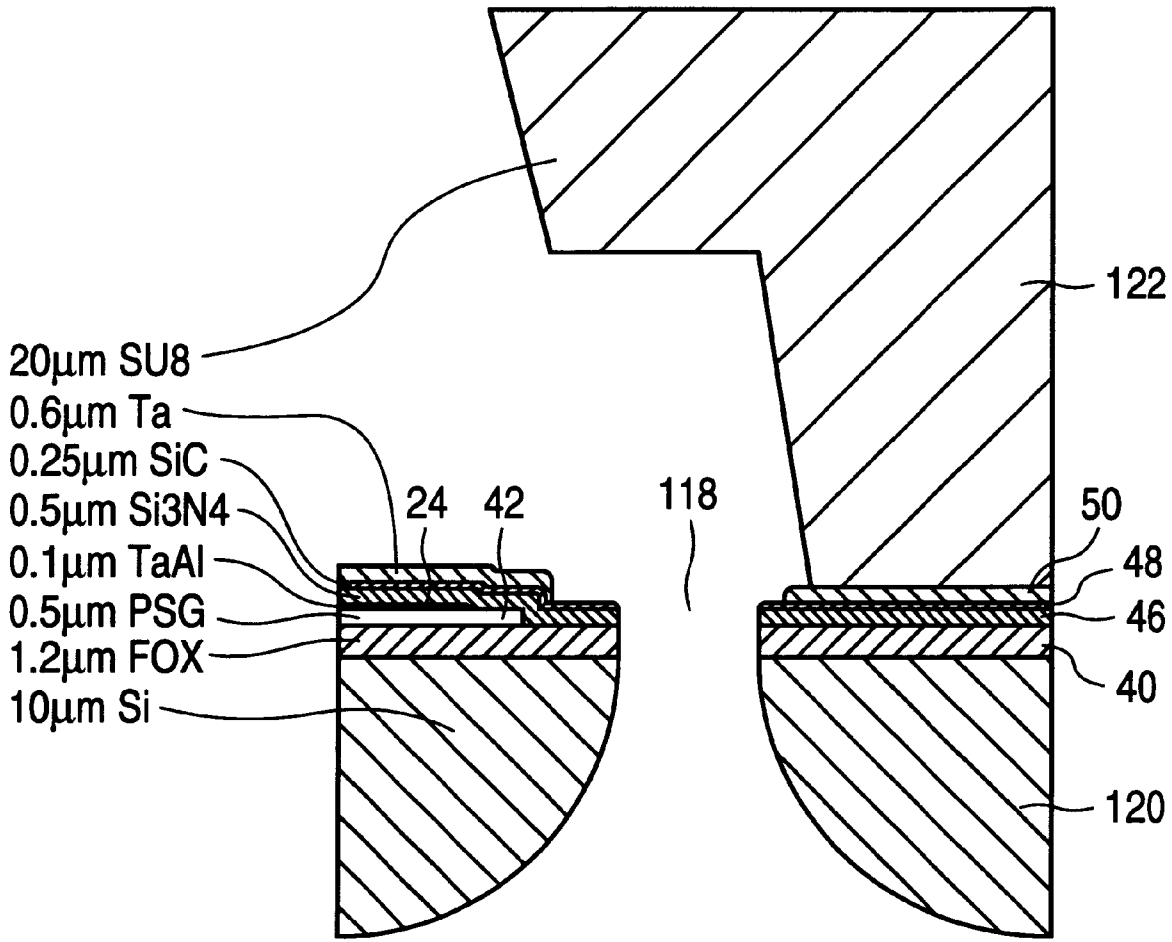
FIG. 11 is a cross-sectional view of a second alternative embodiment of a printhead.

FIG. 11 is a cross-sectional view of a portion of a second alternative embodiment printhead similar to that shown in FIG. 4, except the trench in the silicon is not etched all the way to the thin film. Rather, the bulk silicon 120 is partially etched to form a thin silicon bridge below the heater resistors 24. To accomplish this, before the thin film layers are deposited, the front side of the wafer is patterned with a mask to expose those silicon areas in the trench area which are not to be completely etched through. The exposed portions are then doped with a P-type dopant, such as boron, to an approximate depth of 1 to 2 microns. The depth could be as deep as 15 microns or deeper. The mask is then removed. A backside hardmask is used to define where the trench etch will occur. The back of the wafer is then subjected to a TMAH etch process, which only etches the un-doped silicon portions. Silicon portions in the trench area having a thickness of about 10 microns now underlie the resistors 24.

A similar process may be used to form the thin silicon bridge in FIG. 4.

Thin film layers identified with the same numbers in FIG. 4 may be identical and are subsequently formed using processes similar to those previously described. The thin film layers are then etched, as described above, to form ink feed holes 118. The orifice layer 122 may be identical to that shown in FIG. 8.

One advantage of the printhead of FIG. 11 is that the silicon below the resistors 24 conducts heat away from the resistors 24.

One skilled in the art of integrated circuit manufacturing would understand the various techniques used to form the printhead structures described herein.

The thin film layers and their thicknesses may be varied, and some layers deleted, while still obtaining the benefits of the present invention.

Figure 12:
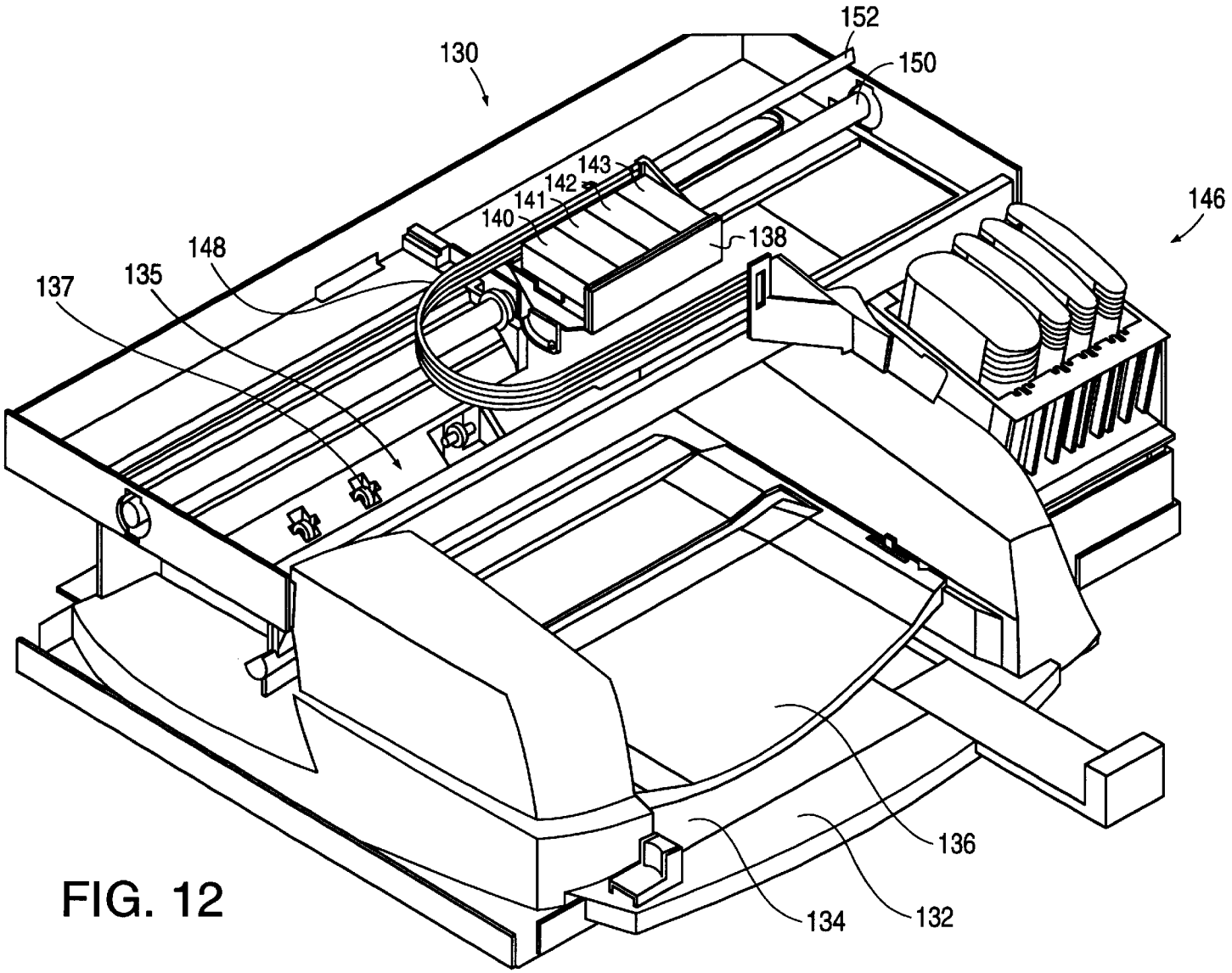
FIG. 12 is a perspective view of a conventional inkjet printer into which the printheads of the present invention may be installed for printing on a medium.

FIG. 12 illustrates one embodiment of an inkjet printer 130 that can incorporate the invention. Numerous other designs of inkjet printers may also be used along with this invention. More detail of an inkjet printer is found in U.S. Pat. No. 5,852,459, to Norman Pawlowski et al., incorporated herein by reference.

Inkjet printer 130 includes an input tray 132 containing sheets of paper 134 which are forwarded through a print zone 135, using rollers 137, for being printed upon. The paper 134 is then forwarded to an output tray 136. A moveable carriage 138 holds print cartridges 140–143, which respectively print cyan (C), black (K), magenta (M), and yellow (Y) ink.

In one embodiment, inks in replaceable ink cartridges 146 are supplied to their associated print cartridges via flexible ink tubes 148. The print cartridges may also be the type that hold a substantial supply of fluid and may be refillable or non-refillable. In another embodiment, the ink supplies are separate from the printhead portions and are removeably mounted on the printheads in the carriage 138.

The carriage 138 is moved along a scan axis by a conventional belt and pulley system and slides along a slide rod 150. In another embodiment, the carriage is stationery, and an array of stationary print cartridges print on a moving sheet of paper.

Printing signals from a conventional external computer (e.g., a PC) are processed by printer 130 to generate a bitmap of the dots to be printed. The bitmap is then converted into firing signals for the printheads. The position of the carriage 138 as it traverses back and forth along the scan axis while printing is determined from an optical encoder strip 152, detected by a photoelectric element on carriage 138, to cause the various ink ejection elements on each print cartridge to be selectively fired at the appropriate time during a carriage scan.

The printhead may use resistive, piezoelectric, or other types of ink ejection elements.

As the print cartridges in carriage 138 scan across a sheet of paper, the swaths printed by the print cartridges overlap. After one or more scans, the sheet of paper 134 is shifted in a direction towards the output tray 136, and the carriage 138 resumes scanning.

The present invention is equally applicable to alternative printing systems (not shown) that utilize alternative media and/or printhead moving mechanisms, such as those incorporating grit wheel, roll feed, or drum or vacuum belt technology to support and move the print media relative to the printhead assemblies. With a grit wheel design, a grit wheel and pinch roller move the media back and forth along one axis while a carriage carrying one or more printhead assemblies scans past the media along an orthogonal axis. With a drum printer design, the media is mounted to a rotating drum that is rotated along one axis while a carriage carrying one or more printhead assemblies scans past the media along an orthogonal axis. In either the drum or grit wheel designs, the scanning is typically not done in a back and forth manner as is the case for the system depicted in FIG. 12.

Multiple printheads may be formed on a single substrate. Further, an array of printheads may extend across the entire width of a page so that no scanning of the printheads is needed; only the paper is shifted perpendicular to the array.

Additional print cartridges in the carriage may include other colors or fixers.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A printing device comprising:

a printhead comprising:

a printhead substrate;

a plurality of thin film layers formed on a first surface of said substrate, at least one of said layers forming a plurality of ink ejection elements;

ink feed holes formed through said thin film layers such that there are more ink feed holes than ink ejection elements; and at least one trench formed in a second surface of said substrate, said second surface being opposite from said first surface, said at least one trench providing an ink path from said second surface of said substrate, through said substrate, and to said ink feed holes formed in said thin film layers, wherein each of said ink feed holes is located over said at least one trench.

2. The device of claim 1 further comprising:

an orifice layer formed over said thin film layers, said orifice layer defining a plurality of ink ejection chambers, each chamber having within it an ink ejection element, said orifice layer further defining a nozzle for each ink ejection chamber.

3. The device of claim 2 wherein said orifice layer is a photoimageable layer formed as an integral part of said printhead.

4. The device of claim 1 wherein said ink ejection elements are heater resistors.

5. The device of claim 1 wherein there are approximately twice as many ink feed holes as ink ejection elements.

6. The device of claim 1 wherein said ink ejection elements reside over said substrate.

7. The device of claim 1 wherein said ink ejection elements reside on a bridge between two portions of silicon, such that said ink ejection elements do not overlie said substrate.

8. The device of claim 1 wherein said at least one trench is etched in said second surface of said substrate.

9. The device of claim 8 wherein said trench extends at least a length of a row of said ink ejection elements.

10. The device of claim 1 further comprising an ink manifold in fluid communication with said ink feed holes for delivering ink to said ink ejection elements.

11. The device of claim 1 wherein each ink ejection element is associated with two ink feed holes, said two ink feed holes being located on opposite sides of each ink ejection element.

12. The device of claim 1 wherein said ink feed holes are arranged along a row parallel to said ink ejection elements.

13. The device of claim 1 further comprising a printer housing said printhead.

14. The device of claim 1 further comprising ink being provided to said at least one opening.

15. The device of claim 1 further comprising a print cartridge body housing said printhead.

16. A method of forming a printhead comprising:

providing a printhead substrate;

forming a plurality of thin film layers on a first surface of said substrate, at least one of said layers forming a plurality of ink ejection elements;

forming ink feed holes through said thin film layers such that there are more ink feed holes than ink ejection elements; and forming at least one trench in a second surface of said substrate, said second surface being opposite from said first surface, said at least one trench providing an ink path from said second surface of said substrate, through said substrate, and to said ink feed holes formed in said thin film layers, wherein each of said ink feed holes is located over said at least one trench.

17. The method of claim 16 further comprising:

forming an orifice layer over said thin film layers, said orifice layer defining a plurality of ink ejection chambers, each chamber having within it an ink ejection element, said orifice layer further defining a nozzle for each ink ejection chamber.

18. The method of claim 16 wherein there are approximately twice as many ink feed holes as ink ejection elements.

19. The method of claim 16 wherein said ink ejection elements reside over said substrate.

20. The method of claim 16 wherein said ink ejection elements reside on a bridge between two portions of silicon, such that said ink ejection elements do not overlie said substrate.

21. The method of claim 16 wherein said forming at least one trench comprises etching said trench in said second surface of said substrate.

22. The method of claim 21 wherein said trench extends at least a length of a row of said ink ejection elements.

23. A method of printing comprising:

feeding ink along at least one trench formed in a first surface of a printhead substrate and through ink feed holes formed through thin film layers on a second surface of said substrate, said second surface being opposite from said first surface, each of said ink feed holes being located over said at least one trench, at least one of said thin film layers forming a plurality of ink ejection elements, there being more ink feed holes than ink ejection elements; and energizing said ink ejection elements to expel ink through associated nozzles.

24. The method of claim 23 wherein there are approximately twice as many ink feed holes as ink ejection elements.

25. The method of claim 24 further comprising flowing said ink into at least one manifold after flowing said ink through said ink feed holes.

26. The method of claim 24 further comprising flowing said ink directly into ink ejection chambers after exiting said ink feed holes.

* * * * *